United States Patent [19]

Cronin

[11] Patent Number: 4,541,701

[45] Date of Patent: Sep. 17, 1985

[54] PHOTOGRAPHIC PROCESSING APPARATUS

[75] Inventor: David V. Cronin, Peabody, Mass.

[73] Assignee: Polaroid Corporation, Cambridge, Mass.

[21] Appl. No.: 593,519

[22] Filed: Mar. 26, 1984

[51] Int. Cl.[4] ..... G03D 9/00; G03D 3/02

[52] U.S. Cl. ..... 354/324; 354/328; 354/331

[58] Field of Search ..... 354/303, 304, 307, 315, 354/316, 323, 324, 328, 331, 336, 337

[56] References Cited

U.S. PATENT DOCUMENTS

| | | | |
|---|---|---|---|
| 2,797,625 | 7/1957 | Fairbank | 354/303 |
| 2,873,660 | 1/1929 | Land et al. | 95/89 |
| 3,255,009 | 6/1966 | Land | 96/61 |
| 3,288,609 | 11/1966 | Land et al. | 95/50 |
| 3,405,617 | 10/1968 | Land et al. | 95/13 |
| 3,405,618 | 10/1968 | Land et al. | 95/13 |
| 3,418,912 | 12/1968 | Land et al. | 95/89 |
| 3,575,099 | 4/1971 | Levenson et al. | 354/328 |
| 3,659,512 | 5/1972 | Dietz et al. | 95/13 |
| 4,121,237 | 10/1978 | Schwartz | 354/328 |
| 4,223,991 | 9/1980 | Brenner | 354/302 |
| 4,361,392 | 11/1982 | Hutchinson | 354/302 |
| 4,493,546 | 1/1985 | Cronin | 354/324 |

*Primary Examiner*—A. A. Mathews

*Attorney, Agent, or Firm*—John S. Vale

[57] ABSTRACT

A processing apparatus is provided for immersion treating a photograhic film unit with a low viscosity processing liquid. The apparatus comprises a flexible bag-like liquid container having a film unit receiving section and a communicating liquid reservoir section, and a device for manipulating the container to selectively change the configuration of the container and the distribution of liquid therein. The device includes a pivoting frame which moves components of the receiving section between an open position for facilitating film insertion and withdrawal and a closed position defining the receiving section which is flooded with liquid from the reservoir section to treat a film unit therein.

13 Claims, 9 Drawing Figures

PHOTOGRAPHIC PROCESSING APPARATUS

BACKGROUND OF THE INVENTION

The present invention relates to the field of photography and, more specifically, to processing apparatus for treating a sheet-like film unit with a low viscosity processing liquid by effecting immersion of the film unit in the liquid for a desired processing interval and then removing it therefrom.

Immersion treatment of a film unit is used in a variety of photographic processes such as developing, fixing, washing, and combination processes utilizing monobath solutions. While the present invention focuses on treating an exposed self-developing film unit with an aqueous alkaline processing liquid to initiate a development and diffusion transfer process, it will become apparent later that the invention is not limited in its scope to this particular application.

The prior art is replete with processing apparatus for facilitating immersion treatment of a sheet-like film unit. Typically, such apparatus include a container holding a supply of processing liquid; means for locating the film unit at an immersed treatment position within the liquid; and means for squeegeeing excess liquid from the film unit in conjunction with its removal from the container.

One common type of apparatus for processing self-developing film units comprises a liquid holding tray into which the film unit is inserted along guideways to a submerged treatment position, and a pair of pressure applying rollers between which the wet film unit is advanced for removing it from the tray while at the same time squeegeeing excess fluid therefrom. Some apparatus are configured to process a self-developing film unit embodied as a single sheet laminate structure having both photosensitive and image receiving layers therein. Other processing apparatus are configured to process film units wherein the image receiving layer is on a separate support sheet which is not immersed in the liquid but is fed through the pressure rollers in superposition with a liquid treated photosensitive sheet to form a diffusion transfer film unit. For representative examples of this type of processing apparatus, see commonly assigned U.S. Pat. Nos. 3,288,609; 3,405,617; 3,405,618; 3,418,912; and U.S. Pat. Nos. 4,223,991 and 4,361,392.

Another type of immersion processing apparatus is disclosed in commonly assigned U.S. Pat. Nos. 2,873,660 and 3,255,009; and 3,659,512.

In FIGS. 1 through 7 of the '660 patent, the apparatus comprises a compressibly deformable, vertically oriented, liquid container having a wiper blade type of squeegee device at its upper film entry end. By applying compressive pressure to the opposite ends of the squeegee device, the interdigitated wiper blades bow out allowing insertion of the film unit into the liquid within the container without interference from the wiper blades. At column 3, lines 68 to 74, it is suggested that the container does not have to be completely filled with the liquid but rather the side walls of the container may be compressed to reconfigure its interior volume and thereby raise the level of the liquid to completely cover that portion of the film unit that is to be immersed for treatment. Following immersion for the prescribed time, the film is manually pulled through the wiper blades to squeegee off excess fluid as the film unit is removed from the container. In other embodiments, shown in FIGS. 8 and 12 through 14, the vertically disposed container is divided into an upper film unit receiving chamber and a lower communicating liquid reservoir. After the film unit is inserted into the upper receiving chamber, the container is inverted to flood the receiving chamber with liquid from the reservoir. Following imbibition, the container is turned upright to drain the liquid back into the reservoir. The wet film unit then is manually pulled through the squeegee device to remove excess fluid.

Commonly assigned U.S. Pat. No. 3,659,512 discloses a self-developing camera having a disposable resilient bladder, holding a supply of processing liquid which is connected to a vertically disposed film treatment chamber. The exposed film unit is inserted into the chamber which is then flooded with the liquid by compressing the bladder (reservior) so it acts as a pump. Following imbibition, the pressure is released and the liquid is drained from the chamber by siphoning action of the bladder.

Immersion processing apparatus, typified by the above noted patents, have several drawbacks that tend to make them somewhat inconvenient and awkward to use and, in some instances, require construction that is relatively expensive.

For example, in film development applications, many prior art apparatus require the user to handle an aqueous alkaline processing liquid when filling the container with fresh liquid and emptying it of deteriorated liquid, or when changing a disposable liquid container. Because of the caustic nature of the processing liquid, care must be taken to avoid spills or contact with the skin. Also, the user must be familiar with procedures for safely neutralizing the liquid should a spill or skin contact occur.

Another disadvantage is that the squeegee devices (e.g., rollers or wiper blades) act directly on the wet film unit and become coated with the processing liquid. If the processing apparatus is not in continuous use, the liquid tends to dry out and form a residue crust on the squeegee device requiring periodic disassembly and cleaning. Also, a liquid residue can build up on the walls and guide structure of the film unit receiving chamber after the liquid is drained therefrom in processing apparatus that use the receiving chamber/reservoir construction.

Those prior art processing apparatus which employ wiper blades for removing excess liquid from the film unit have a further disadvantage in that the blades apply a shearing force directly to the outside surfaces of the film unit. In certain types of film units, such a force may abrade or scratch the outer surface or may cause dislocations in interior layers that soften and/or swell upon absorbing the processing liquid.

Certain photographic processing liquids tend to deteriorate as a result of aerial oxidation caused by prolonged atmospheric contact with the liquid in the container. To minimize this problem, some processing apparatus in the art use elaborate and expensive film entry and exit port closures or seals. Other apparatus use liquid surface passivating techniques such as floating a skim coat of mineral oil on top of the processing liquid. While this method may be effective, it is certainly awkward to implement when the fluid has to be changed.

Copending, commonly assigned U.S. patent application, Ser. No. 473,084 filed on Mar. 7, 1983 and entitled "Photographic Processing Apparatus", now U.S. Pat. No. 4,493,576, discloses an inexpensive and easy to use immersion processing apparatus that overcomes the drawbacks noted above.

The apparatus comprises a compliant liquid container and pressure applying means (e.g., a roller) which acts on the exterior of the container so as not to make direct contact with the processing liquid or an immersion treated film unit in the container.

The liquid container includes a film receiving section and a communicating liquid reservoir section between which a volume of processing liquid, at least sufficient to have such a film unit immersed therein, is selectively distributed to establish a first condition whereby the receiving section is substantially dry and substantially all of the liquid is in the reservoir section, and a second condition whereby the receiving section is flooded with liquid from the reservoir section to immersion-treat a film therein.

The pressure applying means is configured to act on the exterior of the compliant receiving section for selectively pressing portions of the receiving section against the wet film unit therein to squeegee excess liquid from the film unit. The pressure applying means also functions to indirectly exert pressure on the liquid in the receiving section so that the liquid flows into the reservoir section to change the distribution from the second condition to the first condition. The liquid container preferably is in the form of a low cost, flexible plastic bag having an opening at one end through which a film unit is inserted into and withdrawn from the receiving section.

By selectively moving the roller relative to the receiving section, a compressive pressure is applied to seal off the open end of the receiving section; to seal off the reservoir section from the receiving section; to expel air from the receiving section which may tend to impede the flow of liquid thereinto from the reservoir section; and to compress the receiving section to drive liquid therein back into the reservoir section while simultaneously squeegeeing the immersion treated film unit to remove excess liquid therefrom.

While this apparatus performs its intended function satisfactorily, experience has shown that it is somewhat difficult and time-consuming to move a film unit into and out of the receiving section due to the limited access provided by the narrow end opening. This is especially true after the squeegeeing operation which causes the opposed flexible walls of the receving section to remain in close proximity to the outer surfaces of the film unit.

Therefore, it is an object of the invention to provide a photographic processing apparatus which retains the advantages of the apparatus disclosed in the above noted copending application, U.S. Ser. No. 473,084, but is easier to use.

It is another object of the invention to provide such an immersion processing apparatus which is low in cost and is configured to process a film unit quickly thereby making it more suitable for high volume applications.

Yet another object of the invention is to provide such an immersion processing apparatus having improved access to the receiving section for facilitating placing a film unit thereinto for immersion treatment and removing the film unit from the receiving section following squeegeeing.

Other objects of the invention will, in part, be obvious and will, in part, appear hereinafter.

SUMMARY OF THE INVENTION

The present invention provides a low cost and easy to use processing apparatus for immersion treating a sheet-like film unit with a low viscosity processing liquid.

The apparatus includes a compliant liquid container, means for selectively manipulating the container to facilitate film insertion and withdrawal, and pressure applying means acting on the exterior of the container for altering the distribution of liquid therein and for squeegeeing excess liquid from an immersion treated film unit.

The liquid container has a reservoir section and a pair of flexible wall members, coupled to the reservoir section, that are movable relative to each other between closed and open positions. In the closed position, the wall members cooperate to define a compliant film unit receiving section disposed in communicating relation to the reservoir section. When in the open position, the wall members are spaced further apart than when in said closed position to facilitate movement of a film unit into and out of receiving section.

The liquid container is configured to hold a volume of processing liquid, at least sufficient to have a film unit immersed therein, which is selectively distributed within the container to establish a first condition whereby the receiving section is substantially dry and substantially all of the liquid is in the reservoir section, and a second condition whereby the receiving section is flooded with liquid from the reservoir section to immersion treat a film unit therein.

The apparatus further includes means for supporting the liquid container; means operable for selectively moving the wall members between the open and closed positions and pressure applying means.

When the wall members are in the closed position, a pressure applying roller engages the exterior of the compliant receiving section for selectively pressing portions of the wall members against a wet immersion treated film unit therein to squeegee excess liquid from the film unit. The pressure applying roller also exerts a force on the liquid in the receiving section causing it to flow back into the reservoir section.

When the wall members are in the open position, the pressure applying roller serves to compress a passageway leading into the reservoir section thereby providing a releasable seal to prevent leakage of liquid from the reservoir section.

In the illustrated embodiment, the wall members are coupled to the reservoir section in opposed relation for pivotal movement toward and away from each other. The means for selectively moving the wall members between the open and closed positions includes a rectangular frame, to which one wall member is releasably coupled, pivoted on a support or base for movement between opened and closed positions. Advantageously, the pressure applying roller is mounted on the frame from movement therealong over its operative range of positions. This construction simplifies coordinating the operation of the frame and roller as will become apparent hereinafter.

BRIEF DESCRIPTION OF THE DRAWINGS

For a fuller understanding of the nature and objects of the invention, reference may be had to the following detailed description taken in connection with the accompanying drawings wherein.

DESCRIPTION OF THE PREFERRED EMBODIMENT

Figure 1:
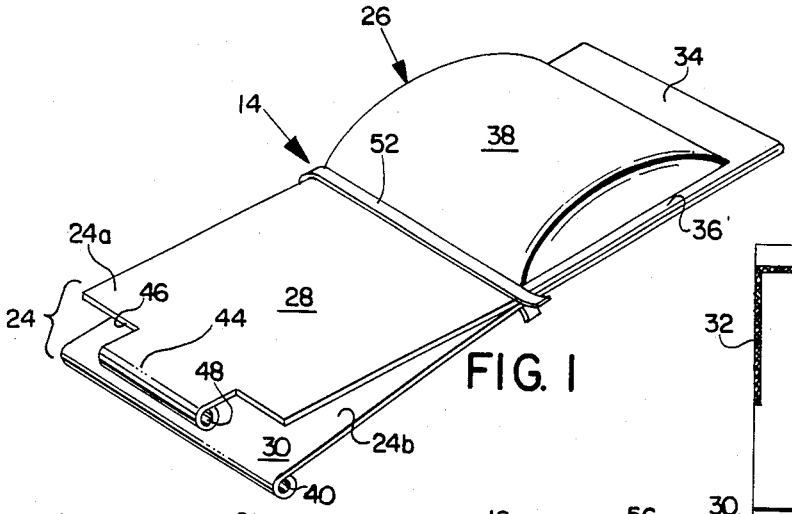
FIG. 1 is a perspective view of a compliant liquid container which is a component of the photographic processing apparatus embodying the present invention.
Figure 2:
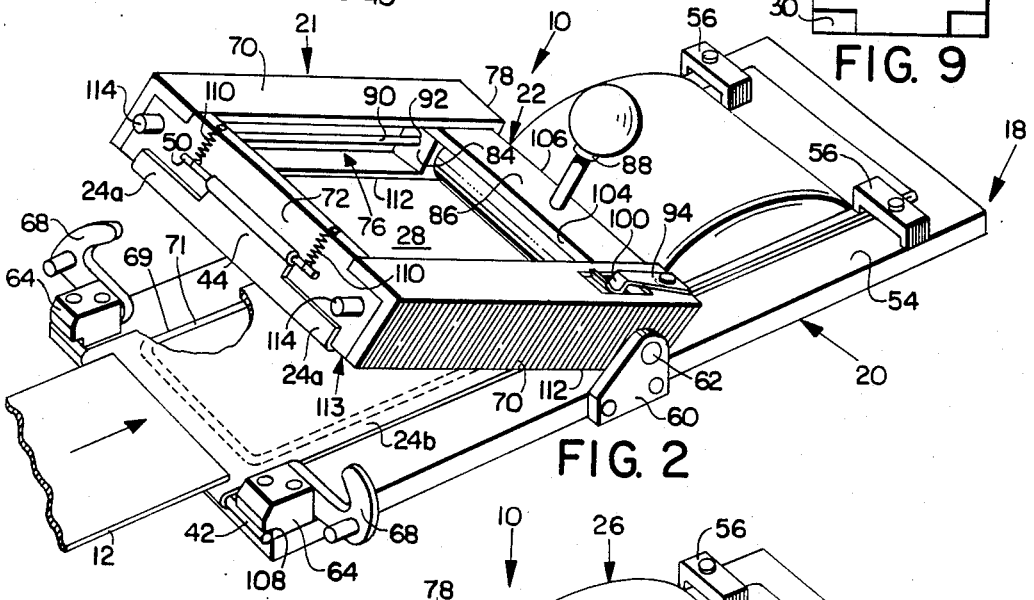
FIG. 2 is a perspective view of the apparatus showing a frame for manipulating one wall of a receiving section of the container in its raised or opened position.
Figure 3:
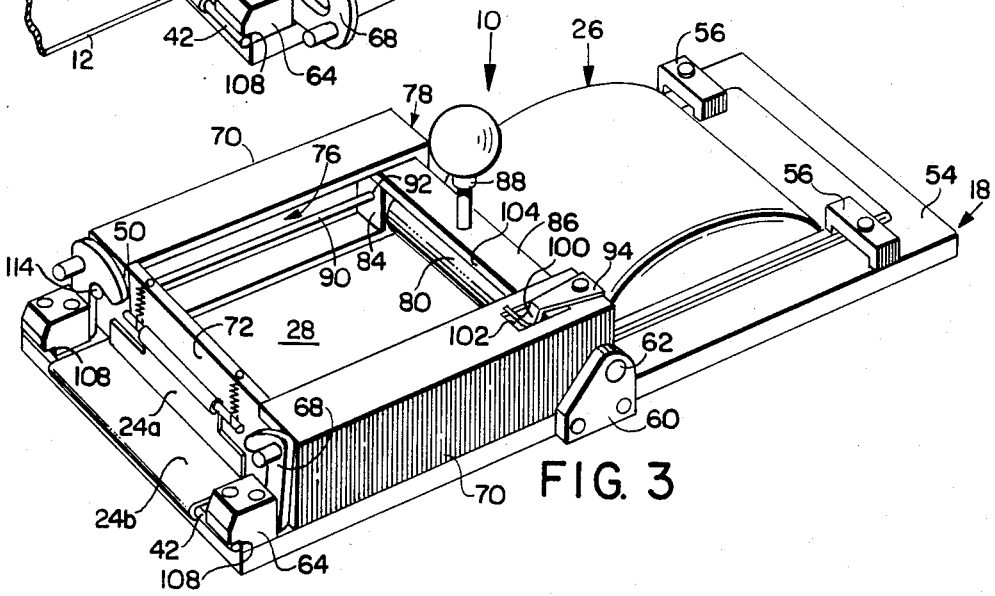
FIG. 3 is similar in some respects to FIG. 2 but shows the frame member in its closed position.

With reference to FIGS. 1, 2 and 3, the present invention provides a low-cost and easy-to-use photographic processing apparatus 10 for immersion treating a sheet-like photographic film unit 12 with a low viscosity (similar to water) processing liquid.

In the illustrated embodiment, apparatus 10 comprises a compliant or flexible container 14 holding a supply of a low viscosity processing liquid 16 (see FIGS. 4 through 8) and a container manipulation device 18. Device 18 includes a base member 20 for supporting container 14; a pivotally mounted rectangular frame 21 on member 20 moveable between the open position of FIG. 2 for facilitating the insertion of a film unit 12 into container 14 or withdrawing it therefrom, and the closed position of FIG. 3 for arranging components of container 14 to form a later to be described liquid tight film unit receiving section; and a pressure roller assembly 22 mounted on frame 21 for selectively applying compressive pressure to container 14 to change the distribution of liquid 16 therein, squeegeeing excess liquid from a film unit 12, and providing a releasable seal within container 14 to prevent liquid leakage when a film unit 12 is being inserted or withdrawn.

Container 14 preferably is prefilled with liquid 16 during manufacture and is provided as a low-cost disposable component of apparatus 10.

After processing a predetermined number of film units 12 (e.g., 10 or 20) in liquid 16, container 14 and the expended liquid 16 therein will be discarded as a unit. As a result of packaging the liquid 16 in a disposable container 14, the user avoids direct contact with the liquid thereby minimizing the risk of spills or contact with the skin. This is especially beneficial if the processing liquid 16 is a caustic aqueous solution of an alkaline material or some other type of active photographic chemical.

In the illustrated embodiment, container 14 is formed of heavy-duty, flexible, plastic sheet material and includes a forward film unit receiving section 24, defined by opposed wall members 24*a* and 24*b*, and a communicating bag-like rear liquid reservoir section or chamber 26. As will become apparent later, when the container 14 is mounted in device 18, the wall members 24*a* and 24*b* are first moved apart to provide easy access for inserting a film unit 12 therebetween. When the frame member 21 is moved to its closed position, the peripheral edges of wall members of 24*a* and 24*b* are releasably sealed together so that the wall-members cooperate to define the liquid-tight receiving section or chamber 24 which is flooded with liquid 16 provided from reservoir section 26 to immersion-treat the film unit 12 therein.

Figure 9:
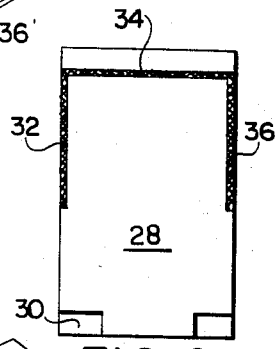
FIG. 9 is a plan view of the container of FIG. 1.

As best shown in FIGS. 1 and 9, container 14 has a generally rectangular shape and may be formed by top and bottom superposed flexible plastic sheets 28 and 30. At the rear of container 14, the peripheral margin portions 32, 34 and 36 of the sheets are bonded or heat-sealed together in face to face contact along 3 edges to form the bag or pouch-like reservoir section 26 which is left open at its forward end to provide an internal passageway 38 (see FIGS. 4 through 8), through which liquid may flow between the reservoir section 26 and the receiving section 24.

At the forward end of container 14, the bottom wall member 24*b* is slightly longer than the top wall member 24*a* simply to fit the configuration of device 18. The forwardmost end of the bottom wall member 24*b* is folded back on itself and bonded or sealed along the free edge to form a hollow transverse channel 40 for receiving an elongated coupling pin 42 employed to releasably attach wall member 24*b* to the base member 20, as best shown in FIGS. 2 and 3. The upper wall member 24*a* has a centrally disposed tab 44, projected forwardly of the leading edge 46, which has a similarly formed channel 48 for receiving a coupling pin 50 used to releasably attach wall member 24*a* to the pivoting frame member 21.

The plastic sheet material forming container 14 should be flexible but fairly strong to resist hydrostatic pressure which is generated when the container is selectively compressed to change the distrubtion of liquid 16 therein. The material should also be chemically compatible with the processing liquid, e.g., in aqueous alkaline developing solution, so that it does not react with the liquid sufficiently to cause deterioration of the plastic material's strength and flexibilty characteristics or contamination of the processing liquid 16. Furthermore, the plastic should be fairly impervious to atmospheric gasses and liquid vapor to prevent liquid loss by evaporation and/or penetration of the container by atomspheric gasses such as oxygen and carbon dioxide which tend to contaminate or cause deterioration of the processing liquid 16. One particular material that has found to be compatible with aqueous alkaline processing liquids and has the other above noted characteristics is polyvinylchloride (PVC).

It is expected that suitable containers 14 may be fabricated from PVC sheet having a thickness in the range 6 to 20 mils. Alternatively, other compatible plastic materials, such as polyethylene, may be used to form container 14. Advantageously, the peripheral seals at margin portions 32, 34 and 36, as well as the fabrication of the attachments channels 40 and 48, may be accomplished by thermal or thermo-compression bonding (including ultrasonic welding) techniques that are well known in the art of manufacturing flexible disposable containers for holding intravenous fluids used in medical applications.

As noted earlier, container 14 is preferably prefilled with liquid 16 during manufacture. The volume of liquid 16 provided substantially fills the reservoir section 26. As best shown in FIG. 1, a slidably removable compressive pressure clamp 52 is provided on the exterior of container 14 for temporarily sealing off the interior passageway 38 to prevent leakage from reservoir section 26 during storage and shipment.

For the purposes of illustration, it will be assumed that film unit 12 is an integral type of self-developing film unit including in its single sheet multilayer structure one or more photosensitive layers and an image receiving layer. The following exposure in a camera to record a latent image in the photosensitive layer (or layers) the film unit 12 will be processed by immersing it in an aqeous alkaline processing liquid for a specified processing interval to initiate a development and diffusion transfer process. For a representative example of such a black and white film unit that is treated with an aqueous alkaline processing liquid which may include a silver halide developer, see commonly assigned U.S. Pat. No. 3,578,450. For a representative example of a color self-developing film unit wherein the aqueous alkaline processing liquid reacts with dye developers in the multilayer film structure, see commonly assigned U.S. Pat. No. 3,701,656.

As noted earlier, apparatus 10 comprises liquid container 14 in combination with the container manipulation device 18.

With reference to FIGS. 2 and 3, device 18 includes the base member 20 comprising a generally rectangular elongated metal base plate 54 for supporting on its upper surface, the reservoir section 26 and the bottom wall member **24*b* of receiving section 24. Components on base plate 54 include a pair of hold-down clamps 56, mounted near the trailing end of plate 54, for engaging the trailing end margin 34 of section 26 to releasably secure the reservoir section at a predetermined operative position on plate 54; a pair of frame mounts 60 secured, by any suitable means, to the opposite lateral sides of plate 54, near its midsection, for pivotally mounting frame 21 for rotation about corresponding pivot pins 62; and a pair of latching-post-assemblies 64, on the forward end of plate 54, for cooperating with pin 42 to releasably secure the bottom wall member 24*b* in place on plate 54 and for mounting a pair of pivoting latch member 68 for releasably latching frame 21 in its closed position. As best shown in FIGS. 2 and 4 through 8, plate 54 has a U-shaped groove 69 in its upper surface, opposite frame 21, holding a conforming compliant rubber gasket 71 therein which will be compressed when frame 21 is closed to effect a liquid-tight seal about the periphery of opposed wall members 24*a* and 24*b* to form the film unit receiving section 24**.

The frame 21 is a generally U-shaped member defined by a pair of lateral side-walls 70 and a leading end wall 72 coupled between the leading ends of side-walls 70. The side-walls 70 are pivotally coupled, near their respective trailing ends, to the mounts 60 on plate 54 by the previously noted pivot pins 62 thereby mounting frame 21 for pivotal motion, towards and away from plate 54, between the open position of FIG. 2 and the closed position of FIG. 3.

Figure 4:
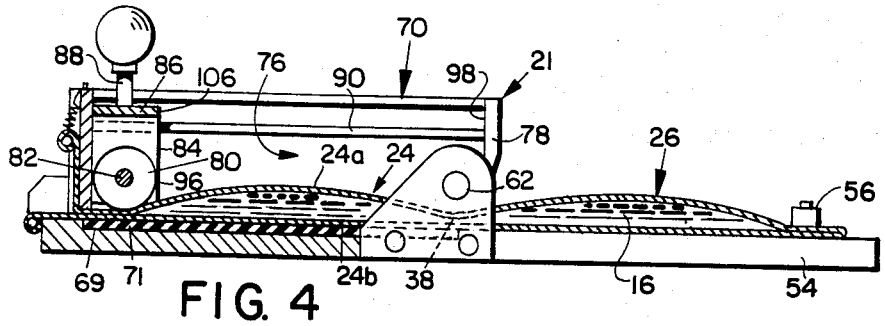
FIGS. 4 through 8 are side elevation views of the apparatus, partly in section, showing the sequential steps in its operation.
Figure 5:
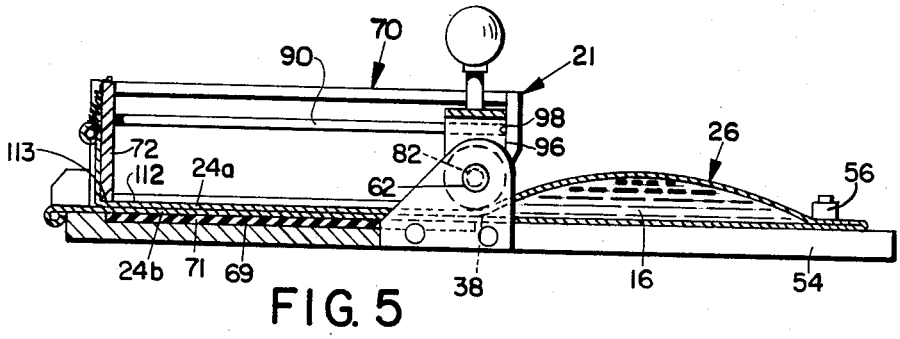
Figure 7:
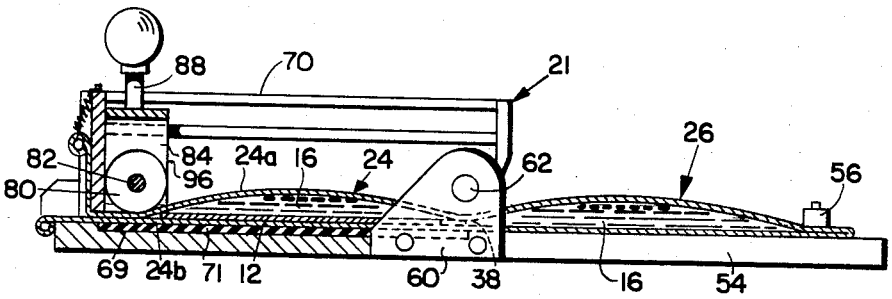

Frame 21 is configured to support the roller assembly 22 which is mounted for sliding movement, in the longitudinal direction, between a forward terminal position, shown in FIGS. 4 and 7, and a rear terminal position shown, for example, in FIGS. 2, 3 and 5.

In the illustrated embodiment, the frame side-walls 70 are formed of three-sided channel stock arranged to have their respective open sides facing inwardly toward the center of frame 21 to define a pair of longitudinally extending guide channels 76 within wall 70 for receiving the opposite lateral ends of roller assembly 22. The trailing ends of the channels 76 are capped by trailing end-wall sections 78 of side-walls 70.

The roller assembly 22 includes a cylindrical roller 80, formed for example of rubber or plastic, rotatably mounted on an axial shaft 82 (see FIG. 4) which is supported at its opposite ends by a pair of generally cubic bearing blocks 84 located in the guide channel 76 for sliding longitudinal movement therealong. The bearing blocks 84 are connected by a rigid transverse bridging crossbar 86 having a centrally disposed upstanding handle assembly 88 secured thereto for facilitating manual manipulation of assembly 22. The lateral ends of crossbar 86 extend into the guide channels 76 and are secured to the top surface of the corresponding bearing blocks 84 by any suitable means, for example countersunk screws (not shown). To insure that roller assembly remains substantially perpendicular to its intended longitudinal direction of travel, the illustrated embodiment includes a pair of longitudinally extending cylindrical guide pins 90, one in each channel 76, secured between the leading end wall 72 and the trailing end wall section 78. Pins 90 pass through corresponding bushings 92 in each of the bearing blocks 84. In this manner, the combination of the bearing blocks 84 captured in channel 76 and guided by the guide pins 90 serves to prevent the manually moveable roller assembly 22 from deviating from its intended path of travel as it is advanced between its terminal positions.

As best shown in FIGS. 2 and 3, the frame 21 includes means, in the form of a leaf spring latch 94, for releasably latching roller assembly 22 in its rearwardmost terminal position wherein the axis of roller shaft 82 is in alignment with a common axis of rotation of frame 21 about pivot pins 62. The reason for latching assembly 22 in the rear terminal position will become apparent later.

Figure 6:
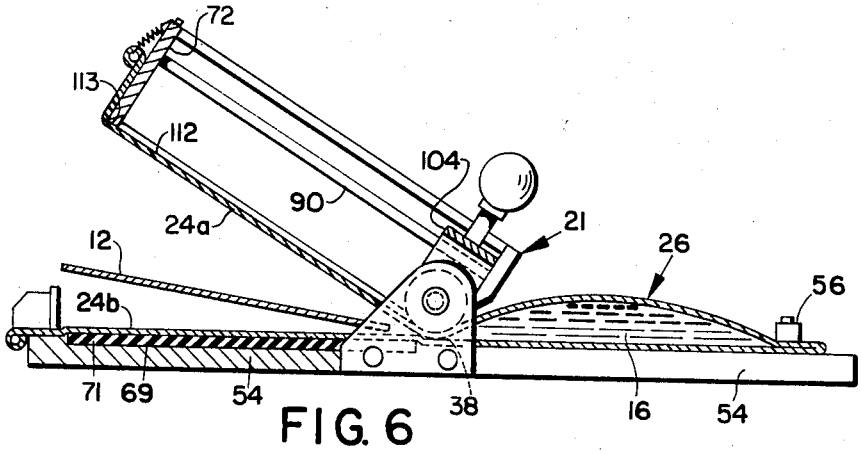
Figure 8:
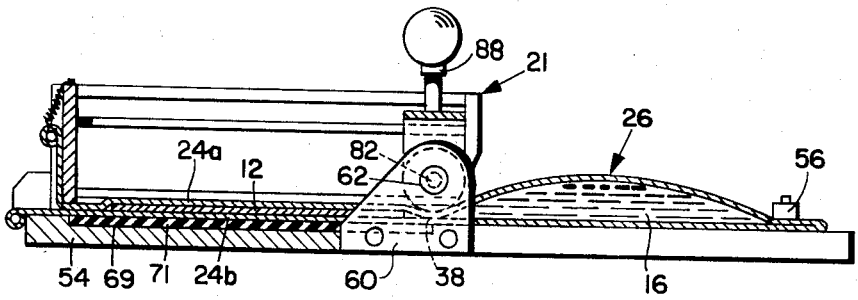

The rear terminal position of roller assembly 22 is set by the operator moving assembly 22 rearwardly in frame 21 until the trailing ends surfaces 96 of the blocks 84 are in abutment with the interior facing surfaces 98 of the corresponding end wall sections 78 as best shown in FIGS. 5, 6 and 8.

Latch 94 is secured, at its trailing end, to the top of the right hand side wall 70 and includes a V-shaped detent 100, formed at its forward free end, which projects downwardly through an opening 102 in the side wall 70 to engage the forward edge 104 of crossbar 86 and releasably retain roller assembly 22 in its rear terminal position. When assembly 22 is moved forwardly, edge 104 cams the detent 100 upwardly allowing the crossbar 86 to slide thereunder thereby unlatching assembly 22. The detent 100 is displaced in a similar manner by the rear edge 106 of crossbar 86 as assembly 22 is moved torwards the rear end of frame 21 to effect latching of assembly 22 in its rear terminal position.

When liquid container 14 is operatively positioned in device 18, the receiving section wall members **24*a* and 24*b* extend under roller 80. The bottom wall member 24*b* overlies the upper surface of the forward portion of plate 54 in covering relation to the peripheral compliant gasket 71. The leading end of wall member 24*b* is releasably coupled to base plate 54 by means of the elongated coupling pin 42 which passes through channel 40 and has its opposite ends positioned in corresponding receiving notches 108 formed in the lower forward ends of latching post assemblies 64**.

Top wall member **24*a* extends forwardly along the underside of frame 21 and its leading end is wrapped up around the lower edge of frame leading end wall 72 to position tab 44 against its forward face. The leading end of wall member 24*a* is releasably coupled to frame 21 by means of the coupling pin 50 which passes through pin receiving channel 48 and has its opposite ends releasably attached to the free ends of a pair of coil springs 110 that had their opposite ends fixed to the upper edge of leading end wall 72. This compliant coupling is provided to compensate for stress which may be induced in top wall member 24 as it moves with frame 21** between the open and closed positions.

The lateral margin portions of wall member 24*a* underline the bottom surfaces 112 of side walls 70 and the front marginal portion underlies the bottom edge surface 113 of leading end wall 72. When frame 21 is fully closed as shown in FIG. 3 surfaces 112 and 113 are in overlying relation to the peripheral gasket 71 and apply a compressive pressure thereto, through the wall members 24*a* and 24*b* thereby compressing gasket 71. The compressed gasket 71 provides an upwardly directed reaction force so that the facing marginal portions of wall members 24*a* and 24 are pressed together to form a liquid tight seal therebetween. In this manner, container manipulation device 18 is operative to arrange wall members 24*a* and 24*b* in operative relation with each other to define the receiving section 24.

The frame 21 is adapted to be releasably latched in its fully closed position, (see FIG. 3) resisting the upwardly directed reaction force of the compressed gasket 71, by means of the latching members 68, on posts 64, which have upper hooked ends that engage corresponding latching pins 114 provided on the leading end wall 72 of frame 21.

In operation, the liquid container 14 is loaded into device 18 by locating the roller assembly 22 forwardly of its rear terminal position and pivoting with frame 21 upwardly to move the bottom of roller 80 away from the top surface of plate 54 so that the receiving section wall members 24*a* and 24*b* may be easily advanced thereunder towards the forward end of device 18. The leading ends of wall members 24*a* and 24*b* are releasably secured to the base plate 54 and frame 21, respectively, using the coupling pins 42 and 50 as described earlier. With frame 21 slightly raised, or least not latched down in its compressed pressure applying closed position, container 14 is moved rearwardly by pulling on it from the rear margin 34 of reservoir section 26 to assure that the wall members 24*a* and 24*b* are taut and wrinkle free. At this point, reservior section 26 is releasably secured in place using the hold-down clamps 56.

Frame 21 is pressed downwardly to compress gasket 71 and is releasably latched in its closed position to seal the peripheral edges of the wall members 24*a* and 24*b* thereby forming the liquid-tight receiving section 24.

The roller assembly 22 is moved rearwardly in frame 21 to its latched rear terminal position. As best shown on FIG. 5, the roller height is preset to apply a compressive pressure to the superposed wall members 24*a* and 24*b* of receiving chamber 24 so as to close the communicating passageway 38 between the receiving section 24 and the reservoir section 26.

With roller 80 providing the liquid tight seal between section 24 and 26, the closepin type compressive clamp 52 may be removed from container 14 without causing liquid leakage from the reservoir section 26.

To flood the receiving chamber 24, the user manually moves the roller assembly 22 from the rear terminal position shown in FIG. 5 to the forward terminal position shown in FIG. 4. This unblocks the communicating passageway 38 and allows the liquid 16 to flow into chamber 24 in response to applying a compressive pressure to the reservoir section 26. The operator may do this simply by pressing downwardly on the top wall of reservoir section 26 with the palm of his hand. Preferably, the reservoir section is configured to hold about twice the volume of liquid necessary to flood the receiving section 24.

To evacuate receiving section 24, the roller assembly is manually moved rearwardly in frame 21 back to its terminal position shown in FIG. 5. Roller assembly 22 cooperates with the underlying base plate 54 to apply a compressive pressure to the exterior of the receiving section walls whereby inducing a hydrostatic pressure in liquid 16 to force it back through passageway 38 into the reservoir section 26. As assembly 22 is moved rearwardly in the frame, the pressure is applied progressively from front to rear of receiving section 24 thereby pressing the wall members 24*a* and 24*b* into face-to-face contact to advance liquid 16 rearwardly into the reservoir section 26. This establishes a first liquid distribution condition whereby receiving section 24 is substantially dry and substantially all of the liquid 16 is in the reservoir section 26.

When apparatus 10 is not in use, it is preferable to flood the receiving section 24 with liquid 16 as shown in FIG. 4. If left substantially dry, minute drops of liquid that may not have been evacuated during a previous processing operation may dry out and form crusty particles in the receiving section 24 which may cause damage to subsequently processed film units 12.

In preparation for processing a film unit 12, the roller assembly 22 is moved from the forward terminal position of FIG. 4 to the rear terminal position of FIG. 5 to evacuate the receiving section 24. With the roller 80 clamping off the reservoir section 26, the frame 21 is unlatched and moved upwardly to the open position of FIG. 6. It will be noted that with roller assembly 22 releasably latched in its rearwardmost position it does not move relative to the passageway 38 when the frame is raised because its axis of rotation is in alignment with the pivot axis of frame 21 defined by the aligned pivot pins 62.

Pivoting frame 21 to the open position causes the top wall member 24*a* to be moved away from the bottom wall member 24*b* whereby the wall members 24*a* and 24*b* are spaced further apart, than when in the closed position defining receiving section 24, to facilitate loading a film unit 12 into position to be immersion-treated in receiving section 24.

As best shown in FIG. 6, the sheet-like photographic film unit 12 is placed on the upper surface of wall member 24*b* within the bounds of receiving section 24 as defined by the gasket 71. Frame 21 is then pivoted downwardly and releasably latched in the closed position thereby bringing the wall members 24*a* and 24*b* into closer proximity and applying the compressive pressure around the periphery to form the liquid-tight seal about the three sides of receiving chamber 24.

To process the film unit 12 now enclosed in receiving chamber 24, the roller assembly 22 is moved forwardly to its forward terminal position and receiving chamber 24 is flooded with liquid 16 by applying a compressive pressure to the reservoir section 26 thereby establishing a second liquid distribution condition as shown in FIG. 7. The film unit 12 remains immersed in liquid 16 for a predetermined imbibition interval, ranging from seconds to minutes depending on the particular type of film unit 12 and processing liquid 16 employed. Following the imbibition interval, the operator manually moves roller assembly 22 rearwardly in frame 21 to its rear terminal position as shown in FIG. 8. As roller assembly 22 is moved rearwardly, it applies a compressive pressure progressively along the length of the flooded receiving section 24 causing the processing liquid 16 to flow back into the reservoir section 26 to passageway 38. In addition to forcing liquid 16 out of receiving chamber 24, the application of the compressive pressure urges the top and bottom wall members 24*a* and 24*b* into face-to-face contact with the opposite outside surfaces of the film unit 12 thereby squeegeeing excess liquid from the film unit as the roller assembly 22 is moved rearwardly toward its rear terminal position.

With roller assembly 22 in its rearwardmost position wherein roller 80 compressively seals passageway 38, the frame 21 is unlatched and moved to its open position thereby moving wall members 24*a* and 24*b* apart to provide better access to the interior of section 24 facilitating withdrawal of the immersion treated film unit 12.

Although the illustrated embodiment is directed to processing single sheet-like film units 12, it is within the scope of the present invention to modify apparatus 10 for sequentially processing successive exposed image frames on an elongated web or strip of photographic film. In this case, the gasket 71 is modified to include, in its upper surface, slight depressions on the laterally side portions thereof. This length of the depressions corresponds to the width of the film strip. With frame 21 in the open position, the film strip is placed on bottom wall member 24*b* so that is lies across receiving section 24 (parallel to roller 80) in overlying relation to the gasket depressions with the frame to be processed centered in the receiving section area bounded by gasket 71. When the frame 21 is closed and latched, the portions of the film strip extending over the lateral margins will be sandwiched between the lateral margins of the opposed wall members to effect the liquid tight seal along the sides of receiving section 24, the extra thickness of film being accommodated by the depressions in the upper surface of the gasket 71. After imbibition and squeegeeing, frame 21 is opened and the film strip is advanced laterally to locate the next frame thereon in position for processing.

Since certain other changes may be made in the above described processing apparatus without departing from the spirit and scope of the invention herein involved, it is intended that all matter contained in the above description or shown in the accompanying drawings shall be interpreted as illustrative and not in a limiting sense.

What is claimed is:

1. Processing apparatus for treating a sheet-like film unit with a processing liquid, said apparatus comprising:

a liquid container having a reservoir section and a pair of wall members coupled to said reservoir section and being movable relative to each other between a closed position, wherein said wall members cooperate to define a compliant film unit receiving section disposed in communicating relation to said reservoir section, and an open position wherein said wall members are spaced further apart than when in said closed position to facilitate movement of a film unit into and out of said receiving section, said liquid container being configured to hold a volume of processing liquid, at least sufficient to have a film unit immersed therein, which is selectively distributed within said container to establish a first condition whereby said receiving section is substantially dry and substantially all of the liquid is in said reservoir section, and a second condition whereby said receiving section is flooded with liquid from said reservoir section to immersion treat a film unit therein;

means for supporting said liquid container;

means operable for selectively moving at least one of said wall members relative to the other between said open and closed positions; and pressure applying means operable when said wall members are in said closed position and configured to engage the exterior of said compliant receiving section for selectively pressing portions of said wall members against a wet immersion treated film unit therein to squeegee excess liquid from the film unit.

2. The processing apparatus of claim 1 wherein said flexible wall members are arranged in opposed relation for pivotal movement toward and away from each other between said open and closed positions.

3. The processing apparatus of claim 2 wherein said flexible wall members include facing peripheral portions thereof which are configured to be pressed into engagement to form a liquid tight seal about a corresponding portion of said receiving section when said wall members are in said closed position.

4. The processing apparatus of claim 1 further including means for applying a compressive pressure to peripheral portions of said flexible wall members located in said closed position to effect a liquid tight seal about that portion of said receiving section not coupled to said reservoir section.

5. The processing apparatus of claim 1 wherein said pressure applying means also functions to indirectly exert pressure on the liquid in said receiving section so the liquid flows into said reservoir section to change the liquid distribution from the second condition to said first condition.

6. The processing apparatus of claim 1 wherein said liquid container has a compliant passageway providing communication for liquid flow between said receiving and reservoir sections and said pressure applying means is operable to apply a compressive pressure to portions of said wall members for releasably sealing said passageway thereby allowing said wall members to be moved to said open position without liquid leaking from said reservoir section through said passageway.

7. The processing apparatus of claim 1 wherein said means for supporting said container includes a base plate for supporting said reservoir section and one of said pair of wall members, and a frame mounted on said base plate to which the other of said wall members is coupled for support.

8. The processing apparatus of claim 7 wherein said frame is pivotally mounted for pivotal movement toward and away from said base plate between open and closed positions and serves as said means for selectively moving said one wall member coupled thereto between said open and closed positions.

9. The processing apparatus of claim 8 wherein said one wall member supported by said base plate is a bottom wall member and the other said wall member coupled to said frame is a top wall member, said base plate further includes a compressible gasket underlying said bottom wall member, and said frame when located in said closed position cooperates with said base plate and gasket to press peripheral portions of said top and bottom wall members, sandwiched therebetween, together to establish a liquid tight seal about that portion of said receiving section not in communication with said reservoir section.

10. The processing apparatus of claim 9 wherein said pressure applying means for selectively pressing said wall members against an immersion treated film unit including a pressure roller configured to engage the exterior of said top wall member and being mounted for movement along a path of travel extending over said receiving section between forward and rear terminal positions.

11. The processing apparatus of claim 10 wherein said container has a compliant passageway providing communication for liquid flow between said receiving and reservoir sections and said roller, when located in said rear terminal position, is operable to apply a compressive pressure to said container to releasably seal said passageway thereby allowing said wall members to be moved to said open position without liquid leaking from said reservoir section through said passageway.

12. The processing apparatus of claim 11 wherein said roller is mounted on said frame for movement relatively thereto along said roller path of travel.

13. The processing apparatus of claim 12 wherein an axis of roller rotation is aligned with a pivot axis of said frame when said roller is located in said rear terminal position so that said frame may be pivoted between said open and closed position without displacing said roller from said rear terminal position where it releasably seals said passageway.

* * * * *